US012024818B2

(12) United States Patent
Bramardi

(10) Patent No.: US 12,024,818 B2
(45) Date of Patent: Jul. 2, 2024

(54) METHOD OF MANUFACTURING ARTIFICIAL LEATHER

(71) Applicant: MARIO LEVI S.P.A., Turin (IT)

(72) Inventor: Marco Bramardi, Rivoli (IT)

(73) Assignee: MARIO LEVI S.P.A., Turin (IT)

( * ) Notice: Subject to any disclaimer, the term of this patent is extended or adjusted under 35 U.S.C. 154(b) by 902 days.

(21) Appl. No.: 17/046,373

(22) PCT Filed: Apr. 10, 2019

(86) PCT No.: PCT/IB2019/052939
§ 371 (c)(1),
(2) Date: Oct. 9, 2020

(87) PCT Pub. No.: WO2019/198002
PCT Pub. Date: Oct. 17, 2019

(65) Prior Publication Data

US 2021/0131028 A1 May 6, 2021

(30) Foreign Application Priority Data

Apr. 11, 2018 (IT) ..... 102018000004398

(51) Int. Cl.
*D06N 3/00* (2006.01)
*D06N 3/14* (2006.01)

(52) U.S. Cl.
CPC ..... *D06N 3/009* (2013.01); *D06N 3/0004* (2013.01); *D06N 3/0011* (2013.01); *D06N 3/0065* (2013.01); *D06N 3/0077* (2013.01); *D06N 3/145* (2013.01); *D06N 2201/042* (2013.01)

(58) Field of Classification Search
CPC ..... D06N 2201/042; D06N 2209/103; D06N 2209/105; D06N 2209/1685; D06N 2211/14; D06N 2211/263; D06N 3/0004; D06N 3/0011; D06N 3/0065; D06N 3/0077; D06N 3/0088; D06N 3/009; D06N 3/14; D06N 3/145
See application file for complete search history.

(56) References Cited

U.S. PATENT DOCUMENTS

| | | | | |
|---|---|---|---|---|
| 5,290,593 A * | 3/1994 | Poletto | D06P 3/24 427/242 |
| 2004/0029470 A1* | 2/2004 | Vogt | D06N 3/0075 442/232 |
| 2008/0102245 A1* | 5/2008 | Mimura | D06N 3/14 428/88 |

FOREIGN PATENT DOCUMENTS

| | | |
|---|---|---|
| CN | 102758359 A | 10/2012 |
| EP | 0504701 A1 | 9/1992 |
| EP | 1793031 A1 | 6/2007 |
| EP | 2953726 A1 | 12/2015 |

OTHER PUBLICATIONS

International Search Report, issued in PCT/IB2019/052939, mailed Jul. 16, 2019, Rijswijk, Netherlands.
Database WPI Thomson Scientific, vol. 2013, No. 57, AN 2013-B595210 XP002787065, London, GB.

* cited by examiner

*Primary Examiner* — Philip C Tucker
*Assistant Examiner* — Jimmy R Smith, Jr.
(74) *Attorney, Agent, or Firm* — Valauskas Corder LLC

(57) ABSTRACT

A method of manufacturing artificial leather is provided. A textile support is provided coated with coagulated polyurethane on which colored and uncolored base coats are applied, interspersed with drying steps, and then embossed to impart an aesthetic design in relief. On the embossed semi-finished product, colored and non-colored finishing coats are applied.

6 Claims, 2 Drawing Sheets

METHOD OF MANUFACTURING ARTIFICIAL LEATHER

CROSS-REFERENCE TO RELATED APPLICATIONS

This application is a National Stage Application of International Patent Application No. PCT/IB2019/052939, having an International Filing Date of Apr. 10, 2019, which claims the benefit of priority to Italian Patent Application No. 102018000004398, filed Apr. 11, 2018, the entire contents of which are hereby incorporated by reference herein.

FIELD OF THE INVENTION

The present invention is to be implemented, particularly but not exclusively, in the automotive, furniture and design technical fields. More specifically, the present invention is applicable to the upholstery of car interiors (seats, door panels, armrests), sofas, armchairs, and chairs. The present invention relates to a method of making artificial leather.

BACKGROUND OF THE INVENTION

In the art, materials called "artificial leather" are known, which, through a method of coating a microfiber non-woven fabric or fabrics with PVC or PU, attempt to imitate the aesthetic aspect of natural leather, starting, as a reference, from a master sample. This objective is not achievable considering the diversity of the manufacturing methods thereof that lead to a different final result both in aesthetic terms of gloss, grain (artificial leather has embossing with deeper incisions than natural leather), color (the pigments used are completely different), and in terms of physical/mechanical characteristics (e.g.: elongations, permanent deformations, heat resistance, etc.). The use of so-called artificial leathers is widespread because an upholstery made entirely of natural leather has a much higher final cost and often is not proportionate to the market for which the product is intended.

In the art are also known methods for the manufacture of a non-woven fabric made of polyurethane coagulate printed and finished like natural leather.

"Hybrid" leather upholsteries are widespread in which a portion of natural leather, in the area that remains most visible during normal use of the covered object, is sewn to portions of artificial leather that are aesthetically similar to the portion of natural leather. Artificial leather portions usually cover parts of the upholstered object that are less visible. Hybrid upholsteries of this type are used, for example, in the interior of automobiles (to cover seats, dashboards, steering wheels, door panels, etc.), in the furniture sector (for sofas, furniture, armchairs, etc.), in the nautical sector (for the helmsman's seat, armchairs, panels in general, doors, handrails, etc.). In this way it is possible to make an upholstery with a certain aesthetic continuity, which does not show differences in the different materials used; the user has the sensation of a product completely upholstered in leather, which, however, has a more affordable cost.

The combination of two different materials, i.e. with non-homogeneous mechanical characteristics, creates a series of variables resulting in aesthetic defects that cannot always be detected during the steps of the individual processes, but only on the complete (upholstered) product. For example, the union of two materials, artificial vinyl leather with natural leather, with elongations of >25% (artificial leather) and <25% (leather) respectively, presents a criticality when sewing together the two materials. The first material, due to the dragging effect of the sewing machine, is significantly longer than the second one, causing potential imperfections such as a "wrinkle effect" or "pinching", which may only be avoided with great skill and experience on the part of the operators involved in the various stages of manufacturing. In particular, the operators manage the entry of the two materials into the machine in a different way, holding back the first and easing the second.

EP 1 793 031 A1 discloses a leather-like sheet material, a process for producing the material and a ball using the same. The process includes the steps of:

- providing a textile support coated with a polyurethane coagulate;
- applying at least one first colored base coat on the textile support, and then causing the first colored base coat to dry;
- applying an additional base coat comprising a fixative, to the first dried colored base coat or to the second dried colored base coat, and then causing or allowing the further base coat layer to dry;
- embossing the colored base coat, imparting a relief design resembling natural leather, thereby obtaining an embossed semi-finished product;
- applying at least one first colored finishing top coat on the embossed semi-finished product;
- applying a second uncolored finishing coat over the first dried finishing coat;
- applying, on the second dried finishing coat, a further fixative coat, and then causing or allowing the drying of the additional fixative coat.

CN 102 758 359 A discloses a method of manufacturing artificial leather, the method comprising the steps of:

- providing a textile support coated with a polyurethane coagulate;
- applying at least one first colored base coat on the textile support, and then causing the first colored base coat to dry;
- embossing the colored base coat, imparting a relief design resembling natural leather, thereby obtaining an embossed semi-finished product;
- applying a nitrocotton class brightener coats on the embossed semi-finished product;
- causing the first colored finishing coat to dry. The coats are applied by spraying, by compressed air guns mounted on carousels. Drying is accomplished in a drying tunnel.

EP 0 504 701 A1 discloses a method of manufacturing artificial leather, the method comprising the steps of:

- providing a textile support coated with a polyurethane coagulate;
- applying at least one first colored base coat on the textile support, and then causing the first colored base coat to dry;
- applying a second colored base coat to the first colored base coat and causing the second colored base coat to dry;
- applying an additional base coat comprising a fixative, to the first dried colored base coat or to the second dried colored base coat, and then causing or allowing the further base coat layer to dry;
- embossing the colored base coat, imparting a relief design resembling natural leather, thereby obtaining an embossed semi-finished product;
- applying at least one first colored finishing top coat on the embossed semi-finished product;
- causing the first colored finishing coat to dry.

SUMMARY OF THE INVENTION

It is the object of the present invention to create an artificial leather upholstery that has properties similar or identical to those of natural leather in terms of the following characteristics:

i) aesthetic, in terms of color, degree of gloss, and grain (embossing that defines the aesthetic design of the leather);

ii) tactile (sensation perceived by touching the surface of natural leather);

iii) mechanical, with a tear resistance comparable to that of natural leather; and iv) resistance to heat exposure similar to the resistance of natural leather, for which is envisaged resistance to a temperature of more than 110° C. for exposure to hot air blowing for more than 20 seconds at a distance of 10 cm.

It is desired, moreover, to reduce the gap in the aesthetic/mechanical performance of the various materials (less luxurious and therefore less expensive) that make up the linings for upholstery in the many varied fields between natural leather and the artificial materials with which natural leather is combined.

The present invention provides a manufacturing method that uses a synthetic non-woven microfiber fabric of polyurethane coagulate, treated according to a method, and with the same products, as natural leather. The method allows to obtain a finished product made of artificial leather (or artificial leather) having characteristics and strength similar to natural leather.

The aforesaid and other objects and advantages, which will be better understood hereinafter, are achieved by the method described and claimed herein.

In summary, for the manufacture of artificial leather, a textile support covered with polyurethane coagulate is prepared on which layers of colored and non-colored base coats are applied. After the application of the base coats, interspersed with passages in hot air tunnels for drying, the embossing is carried out. This operation is carried out, after the application of the base coats, to impart an aesthetic design in relief to characterize the leather as desired. Two colored finishing coats and one fixative coat are applied to the embossed semi-finished product thus obtained. The drying steps involve the respective passage of the textile support through one or more drying tunnels, to cause the crosslinking of the layers applied in succession. The base and finishing coats are applied by spraying, feeding the textile support through multiple spray booths in which are provided one or more carousels moving in a circular motion, each having a plurality of spray guns.

The present invention further relates to an artificial leather product obtained by the claimed method. The product thus obtained has functional and perceptible characteristics very similar to natural leather, which the product of the present invention matches perfectly.

BRIEF DESCRIPTION OF THE DRAWINGS

Further characteristics and advantages of the invention will become clearer in light of the detailed description of some preferred but non-limiting embodiments, illustrated by way of example with references to the accompanying figures, wherein.

DETAILED DESCRIPTION

According to an embodiment, a method for the manufacture of an artificial leather upholstery comprises the steps described below.

A textile support is prepared, preferably with a base made of synthetic microfiber non-woven fabric, e.g. viscose, coated with polyurethane coagulate, preferably aliphatic or aromatic polyurethane coagulate.

According to an alternative embodiment, the fabric base may be made of natural fiber.

A first layer of colored base coat is applied to the textile support, e.g. a colored base coat with an aliphatic polyurethane or pigmented aromatic base. The first colored base coat is used to enable the adhesion of a series of subsequent coats, as explained below.

The colored base coats are applied by means of a spray booth, through which the textile support is fed. The support is carried by a conveyor belt, such as a wire conveyor belt, which moves linearly in a given direction or path through the booth. The coloring material may be applied by a moving carousel of circular motion having a plurality of spray guns for the atomized distribution of the color or material to be applied. The rotary movement of the carousel distributes the dye evenly over the entire surface of the semi-finished product. The number of spray guns may vary, for example from 10 to 16, depending on the specific amount of dye required. Spray finishing lines suitable for the implementation of the method are known in the art and do not require a detailed description here. Finishing lines produced and marketed, for example, by EL.PA Service S.r.l., Altavilla Vicentina (VI) or GE.MA.TA. S.p.A., of Trissino (VI), Italy may be used. The first colored base coat ("base coat 1") is then dried, by passing the textile support through a drying tunnel.

On top of the first dried base coat, optionally, a second colored base coat (base coat 2) may be applied, preferably in the same way as for the application of the first coat. The second layer of colored base coat serves to better outline the final color of the upholstery.

The second colored base coat is then dried, by passing the textile support through a drying tunnel.

On the first or second dried base coat, an additional base coat (base coat 3) may be applied, consisting of a fixative, which may be transparent or colored. The fixative is applied by spraying. The fixative is used to prepare the semi-finished product for the subsequent embossing step. The additional base coat may also be applied in the same ways as for the application of the first and second layers. The additional base coat is dried, preferably by passing the semi-finished product through a drying tunnel.

The semi-finished product thus obtained, comprising the textile support on which two or three base coats have been applied, is embossed to give the semi-finished product a relief design (leather grain) to characterize the surface as desired.

Figure 1:
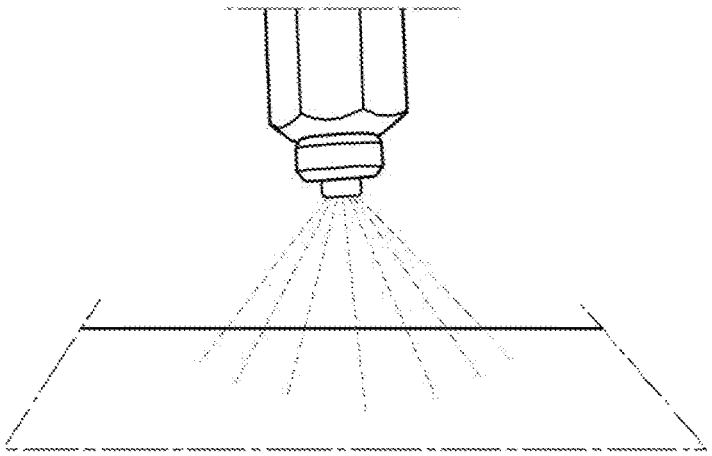
FIG. 1 is a perspective view of a spray gun.
Figure 2:
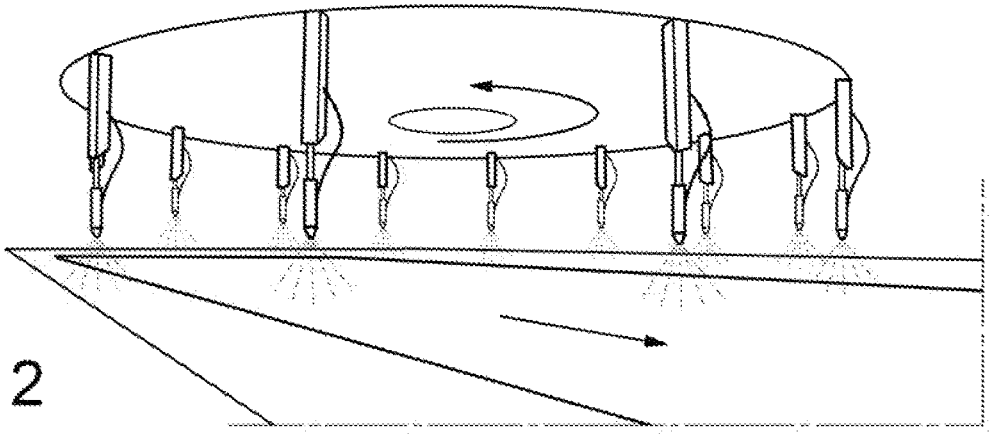
FIG. 2 is a perspective view of a rotating carousel located inside a spray booth and bearing a number of spray guns.
Figure 3:
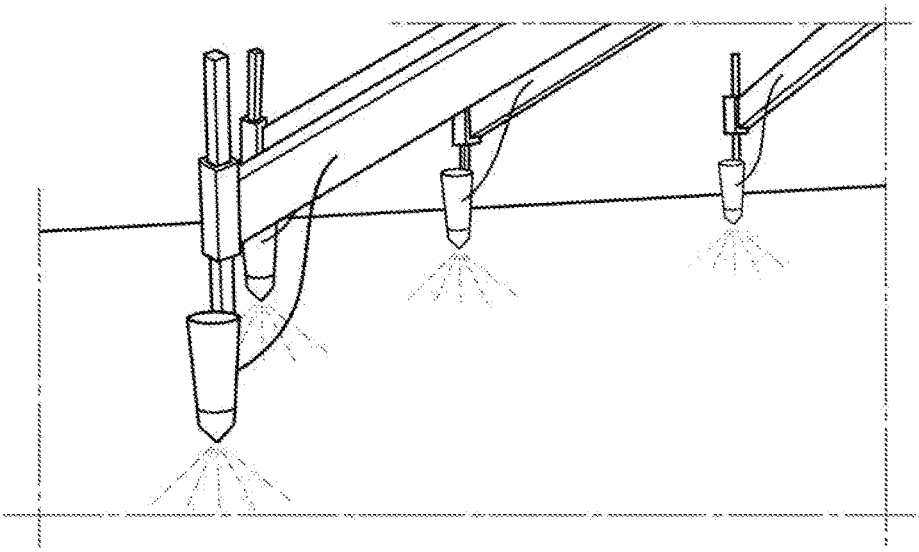
FIG. 3 is a perspective view of a spray gun in operation inside the spray booth.
Figure 4:
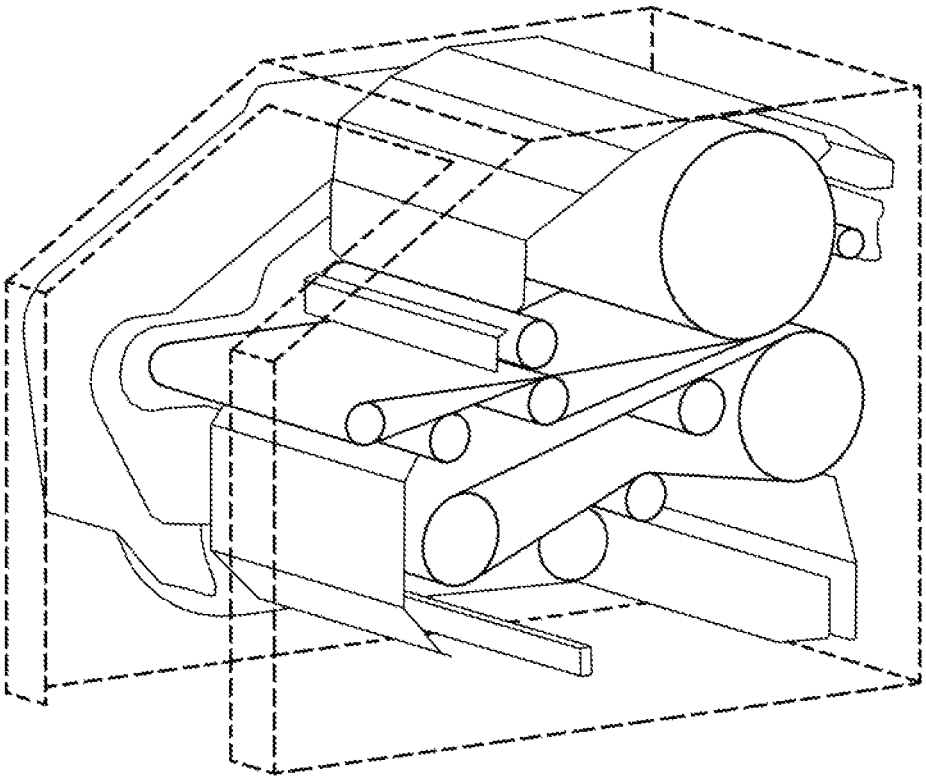
FIG. 4 is a perspective view of a rotary printing machine.
Figure 5:
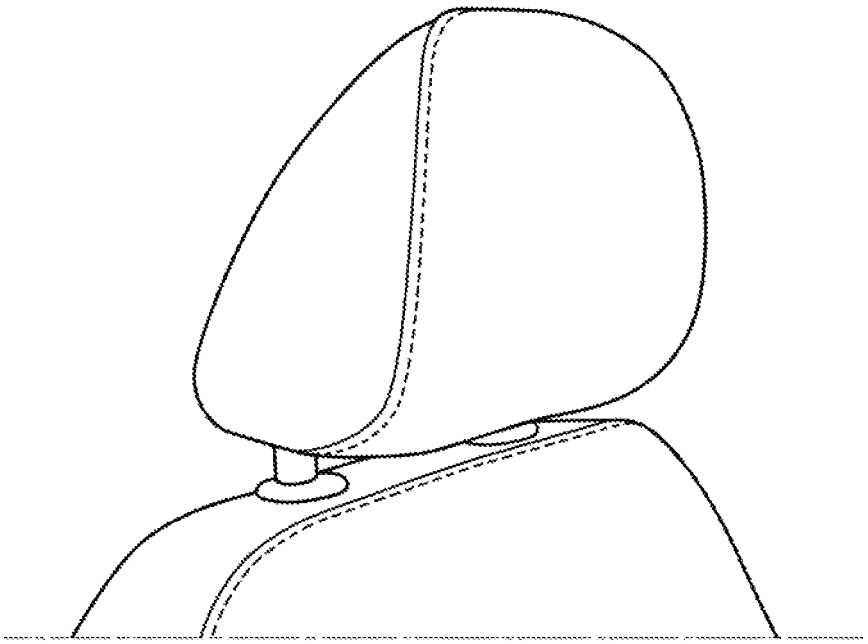
FIG. 5 is a perspective view of a headrest of a vehicle seat with a front part upholstered with natural leather and a side part upholstered with artificial leather.

The embossing may be imparted either with a rotary printer for leather (FIG. 4), a hot rotary cylinder, or flat printing presses for leather with thermo-adjustable plate, in pieces of a size corresponding to the surface dimensions of the semi-finished product.

Alternatively, embossing (or rotary print) may be imparted continuously by pressure using special calendering machines (embossers). The depth of the embossing may be adjusted by varying the following parameters: feed speed of the conveyor belt for the semi-finished products, temperature and pressure of the calenders.

After embossing, the semi-finished product may be allowed to cool down, for example by leaving it exposed to air for a few hours.

On the embossed semi-finished product, a first finishing coat is applied (top coat 1) composed, for example, of a mixture of catalyzed, opaque or glossy fixatives, depending on the final result to be obtained, with a pigmented aliphatic polyurethane base. The first colored finishing coat is used to carry the color-printed base coat. Preferably the colored finishing coat is applied by means of a spray booth, through which the embossed semi-finished product is fed. The dyeing material may be applied by a carousel with a plurality of spray guns, for example moved in a circular motion, according to known methods.

The first colored base coat is then dried, preferably passing the textile support through a drying tunnel.

Over the first dry finishing coat, a second colored finishing coat (top coat 2) is applied, for example a catalyzed colored finishing coat, preferably in the same way as for the application of the first coat. The second colored finishing coat is used to bring the color within a range of predefined colorimetric coordinates ($\Delta E$: <0.5) referring to a defined master color.

The second colored finishing coat is dried, passing the semi-finished product through a drying tunnel.

On the first dried colored finishing coat, or on the second dried finishing coat, if provided, an additional coat of transparent catalyzed fixative (top coat 3) may be applied, preferably by spray. The transparent fixative is used to create a barrier to fix the previously applied coat. The third top coat is dried, preferably by passing the semi-finished product through a drying tunnel.

The drying steps described above involve the consequent crosslinking of the chemical products applied in succession. Preferably, the drying temperature in the drying tunnels is 100° C.±15° C.

Several spray booths may be provided along the route followed by the semi-finished products. Ventilated (hot) ovens may be present between one booth and the next to allow the correct crosslinking of the product applied to the support. The spray line may be the same for both steps of product distribution on the support, both for the application of the colored base coats and for the application of the catalyzed finishing coats.

Optionally, the material may be cooled upon exiting the drying tunnels. For this purpose, a cold room (or "chiller") may be installed, for example a humidity-controlled cold room, equipped with a radiator and condensation unit. Alternatively, a cooling unit with simple ventilation may be installed. The purpose of cooling is to accelerate the stacking or rolling up of the finished material, and to limit the deposit of atmospheric dust on the electrostatically charged product.

The division of the coloring process into distinct steps, with an intermediate embossing step between the steps of applying the colored base coat and the (one or more) steps of applying the colored top coat has the following advantages. The application of the base coat, before embossing, gives the textile support a base coloring that will only need to be adjusted, after embossing, to reach the final tone required. The base coat has an additional advantage in that it creates an additional layer of thickness on the textile support that improves the three-dimensionality and quality of the subsequent printing (or embossing).

The dosage of the applied material may be adjusted by varying the linear feed speed of the conveyor belts that transport the semi-finished products through the spray booths, as well as by varying the movement speed of the carousels that carry the spray guns inside each booth.

The linear feed speed of the semi-finished products through the spray booths varies according to the type of color; the speed is faster for the application of dark colors, while the speed is slower for light or delicate tones. As an indication, the feed speed is preferably between about 8 and 16 m/min., preferably about 12 m/min., with the exception of the feed speed in the first step of spraying the first colored base coat, where the speed is preferably between about 9 and 15 m/min., preferably about 12 m/min.

The angular speed of the carousels of the booth, to which guns are attached for the color or fixing spray, may be indicatively on the order of 8-10 rpm.

The sequence of steps and products used on the finishing line varies according to the article to be manufactured. Therefore, if the cycle of the leather provides for color top-dyeing, then the material in question will follow the same flow to become uniform.

For the first and second booth, both dedicated to the distribution of the first coat of color, the circuit pressure is equal to 5 bar±1 and the pressure of the spray guns 2.5±0.5 bar. The third booth, intended for the fixative, has a circuit pressure of 6 bar±1 and guns of 2 bar±0.5.

By way of example, the production line may provide the following alternatives:

1. three spray booths are used: two for the base, consisting of the base coat 1 and the base coat 3, as described in the previous paragraphs, and ending with the application in the third booth of the top coat 2, interspersed with the embossing step;
2. four spray booths are used: two for the base, consisting of the base coat 1 and base coat 3, as described in the previous paragraphs, and ending with the next two booths consisting of the top coat 2 and the top coat 3, interspersed with the embossing step;
3. five spray booths are used: three for the base, consisting of the base coat 1, the base coat 2 and the base coat 3, as described in the previous paragraphs, and ending with the subsequent two booths for the top coats 2 and 3, interspersed with the embossing step;
4. six spray booths are used: three for the base, consisting of the base coat 1, the base coat 2 and base coat 3, as described in the previous paragraphs, and ending with the subsequent three top coat booths (top coat 1, top coat 2 and top coat 3), interspersed with the embossing step.

When the material leaves the finishing line it is completed. The gloss values and visual and instrumental color readings are verified with samples using a spectrophotometer (for example: Datacolor spectrophotometer, Gretag-Macbeth spectrophotometer, X-RITE spectrophotometer) for a correct stage advancement. Finally, the product undergoes a quality inspection for approval.

The material produced according to the present method may then be treated in several ways depending on the final use for which it is intended. It may be coupled to a PE or PES sponge backing, sewn with similar, identical or different materials (e.g. natural leather), further hot-printed, printed with color or alternative layers to create characterization designs or lettering.

The non-woven fabric covered with printed and finished polyurethane coagulate obtained by the present method shows a remarkable resistance to mechanical and dynamometric seals, similar to those of leather, a pleasantness to the touch and a high durability, a clean aesthetic and perceptible similarity whereby it is particularly suitable for combining with natural leather in all the applications thereof. The thickness, the uniform mass, the seam strength and various elongations make the product versatile and suitable and many applications in the automotive, aviation, furniture and nautical fields, etc. The product obtained through the present method is very similar to natural leather and for all that concerns the aesthetic and mechanical characteristics, it is soft and pleasant to the touch, has a good intensity of color and correct gloss that may be matched to natural leather, and has the depth of printing (embossing) equal to that of the grooves in natural leather.

The invention may undergo numerous modifications and variations depending on the color, the aesthetic embossing (printing), the physical/mechanical characteristics to be obtained, all of which, however, fall within the inventive concept expressed in the accompanying claims. All chemical products may be replaced by other technically equivalent elements, and the parameters will be calibrated differently according to the needs, without departing from the extent of protection of the present invention.

The following tables show the compositions of the material and physical and mechanical characteristics of the artificial leather material manufactured according to the invention, from which the results achieved by the product are evident.

TABLE A

| Configuration | |
|---|---|
| Material composition | textile support (35% ± 20%)/coagulated and finished with PU (65% ± 20%) |
| Textile support | Microfibers, non-woven fabric, synthetic fabrics, natural fibers fabrics |
| Finishing | 100% PU (aliphatic/aromatic) |

TABLE B

| Technical data sheet | | | | |
|---|---|---|---|---|
| CHARACTERISTICS | METHOD | REQUIREMENTS | U.M | RESULTS |
| Organoleptic inspection | Master comparison | — | — | visual grain conformity, pleasant feel |
| color checking | spectrophotometer | delta E < 0.5 | | 0.10 |
| Shining | ISO 2813 ASTM D2457 | ±0.2 | gloss | 0.70 |
| Total thickness | UNI EN ISO 2589 | 0.9 ÷ 1.3 | mm | 1.24 |
| Unit mass | UNI EN ISO 2420 | 580 ÷ 700 | $g/m^2$ | 644 |
| Adherence between PU coagulated and support | FCA 50428 B | ≥5 daN | daN | 6.1 |
| Adherence between PU coagulated and support in heat coating condition (2 H 75° C.) | FCA 50428 B | no adherence and no staining | — | no adherence and no staining |
| Tensile strength lengthwise | FCA 50441/02 | ≥30 | daN | 67.3 |
| Tensile strength widthwise | FCA 50441/02 | ≥20 | daN | 57.2 |
| Elongation lengthwise | FCA 50441/02 | ≤25% | % | 19.0 |
| Elongation widthwise | FCA 50441/02 | ≤25% | % | 6.3 |
| Tear strength lengthwise | FCA 50442 | ≥6 | daN | 20.5 |
| Tear strength widthwise | FCA 50442 | ≥6 | daN | 20.1 |
| Wear resistance | FCA 50455 - Met.A | 3000 cycles 30N no alteration | — | No alteration |
| Extended Wear resistance | FCA 50455 - Met.A | 6000 cycles 30N no alteration | — | No alteration |
| Degree of slipperiness | FCA 50437 | ≤26° | ° | 21 |
| Colorfastness to artificial light | UNI EN ISO 105/B02 150 hours | 150 h ≥5 Gray Scale | Gray scale | 5 |
| Colorfastness to artificial light | UNI EN ISO 105/B02 300 hours | 300 h ≥4 GS | GS | 4 |

TABLE C

| Technical data sheet | | | | |
|---|---|---|---|---|
| CHARACTERISTICS | METHOD | REQUIREMENTS | U.M | RESULTS |
| Colorfastness to rubbing with neutral soap | FCA 50444 | 5 | GS | 5 |
| Colorfastness to rubbing with alcohol | FCA 50444 | 5 | GS | 5 |
| Colorfastness to rubbing with artificial perspiration | FCA 50444 | 5 | GS | 5 |
| Heat Aging | UNI EN ISO 17227 48 h to 90° C.' | No alteration | — | No alteration |
| Flexing endurance | UNI EN ISO 5402 | ≥150 000 cycles no cracks | — | No cracks |
| Seam strength | FCA 50441 | ≥10 | daN | 50, 5 |
| Flammability | ISO 3795 | ≤100 | mm/min | Self-extinguishing |
| Cold cracking resistance | FCA 50429 B 10 mm mandrel (6 h at no cracks-30° C.) | No cracks | — | No cracks |
| Peeling Resistance | FCA 50438/01 | no alteration | | no alteration |
| Fogging test | DIN 75201 Type B | ≤3.5 | mg | 2.3 |
| Amine contamination resistance | FCA 50455/08 | no garlic smell | | no garlic smell |
| volatile substances | LP-463DD-04-01 | — | % | 2.4 |
| resistance to thermal cycling test | MS-JK-3600 LP-463-LB-12-01-A | >4 GS no loss of embossing or other | GS | no alteration |
| Behavior in humidity | UNI EN ISO 17227 200 h - 40° C. - 90% u.r. | no peeling, no break | — | no peeling, no break |
| water immersion resistance | ML Procedure: 48 h - 60° C. | no appearance variation, no hydrolysis | — | no appearance variation, no hydrolysis |
| Abrasion strength TABER | UNI EN ISO 17076-1 1800 cycles/ CS-17/10N | No break | — | No break |
| Scuffing strength | MS-JK-3600 SAE J 365 Head A - 0.9 kg load - 200 cycles | No break | — | No break |
| Hydrolysis resistance | ML Procedure | no hydrolysis | — | no hydrolysis |

The invention claimed is:

1. A method of manufacturing artificial leather, the method comprising:

providing a textile support coated with a polyurethane coagulate;

applying at least one first colored base coat on the textile support, and causing the at least one first colored base coat to dry;

optionally applying a second colored base coat to the at least one first colored base coat and causing the second colored base coat to dry;

applying an additional base coat comprising a fixative, to the at least one first dried colored base coat or to the second dried colored base coat, if provided, and causing or allowing the additional base coat to dry, thereby obtaining a semi-finished product embossing the semi-finished product by imparting a relief design resembling natural leather, thereby obtaining an embossed semi-finished product;

applying a first colored finishing coat on the embossed semi-finished product;

causing the first colored finishing coat to dry;

applying a second colored finishing coat over the first dried colored finishing coat;

causing the second colored finishing coat to dry;

applying, on the second dried colored finishing coat, an additional fixative coat, and causing or allowing drying of the additional fixative coat;

wherein each said step of causing the base coats, the finishing coats, and the additional fixative coat to dry involves a respective passage of the textile support through one or more drying tunnels, to cause cross-linking of the polyurethane coagulate and each coating, the drying temperature in each respective one or more drying tunnels ranging from 85° C. to 115° C.; and said base and finishing coats are applied by spraying, feeding the textile support through one or more spraying booths comprising one or more carousels moved in circular motion, the one or more carousels having a plurality of spray guns.

2. The method of claim 1, wherein embossing is imparted in at least one of the following ways:

by a rotary printer for leather, with a hot rotary cylinder;

by flat printing presses for leather, with thermo-adjustable plate, the thermo-adjustable plate having a size corresponding to surface dimensions of the semi-finished product; and by pressure, continuously, through one or more embossing machines.

3. The method of claim 1, wherein the textile support comprises a base made of synthetic microfibrous non-woven fabric.

4. The method of claim 3, wherein the synthetic microfibrous non-woven fabric comprises viscose.

5. The method of claim 1, wherein after embossing, the embossed semi-finished product is allowed to cool by exposure to air for at least two hours.

6. The method of claim 1, wherein artificial leather exiting the one or more drying tunnels is subjected to a forced cooling phase by passage through a cold room, or by ventilation.

* * * * *